US007163412B2

(12) United States Patent
Fan et al.

(10) Patent No.: US 7,163,412 B2
(45) Date of Patent: Jan. 16, 2007

(54) CABLE CONNECTOR ASSEMBLY WITH AN ANTI-DISENGAGEMENT DEVICE

(75) Inventors: Chia-Hao Fan, Tu-Cheng (TW); Chin-Pao Kuo, Tu-Cheng (TW); Yu-Lung Shih, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/169,398

(22) Filed: Jun. 28, 2005

(65) Prior Publication Data

US 2006/0246763 A1 Nov. 2, 2006

(30) Foreign Application Priority Data

Apr. 29, 2005 (TW) ..... 94113943 A

(51) Int. Cl.
*H01R 13/62* (2006.01)

(52) U.S. Cl. ..... 439/258

(58) Field of Classification Search ..... 439/352, 439/358, 258, 304, 302, 309, 362, 372, 257
See application file for complete search history.

(56) References Cited

U.S. PATENT DOCUMENTS

| | | | | |
|---|---|---|---|---|
| 5,154,629 | A * | 10/1992 | Carver et al. | 439/352 |
| 5,197,900 | A * | 3/1993 | Ellis et al. | 439/352 |
| 5,641,299 | A * | 6/1997 | Meguro et al. | 439/347 |
| 5,921,801 | A | 7/1999 | O'Sullivan et al. | |
| 5,971,790 | A | 10/1999 | Rohde | |
| 6,461,185 | B1 * | 10/2002 | James | 439/352 |

* cited by examiner

*Primary Examiner*—Phuong Dinh
(74) *Attorney, Agent, or Firm*—Wei Te Chung

(57) ABSTRACT

An electrical connector includes an insulative housing, a plurality of terminals retained in the housing, a locking device for locking with a complementary connector and an electrically actuated anti-disengagement device having a holding status and a releasing status and being reverseable between the two status. Only when the anti-disengagement is in the releasing status, the locking device is able to engage with or disengage from the complement connector.

6 Claims, 11 Drawing Sheets

CABLE CONNECTOR ASSEMBLY WITH AN ANTI-DISENGAGEMENT DEVICE

BACKGROUND OF THE INVENTION

1. Field of the Invention

The present invention relates to a cable connector assembly, and more particularly to a cable connector assembly having an anti-disengagement device for preventing an untimely disengagement of the cable connector assembly from a complementary connector.

2. Description of Related Art

As everybody known, electrical connectors are devices provided for interconnecting a notebook computer and periphery equipments, such as a scanner or a printer et al. In general, an electrical connector is equipped at the computer for serving as a docking and a cable connector assembly is equipped at the periphery equipments for serving as a sailer. The cable connector assembly comprises a cable end connecter for electrically connecting with the docking connector and a cable which is provided with one end connecting the periphery equipments and the other end connecting the cable end connector. For securing the engagement and the signal transmission between the cable connector assembly and the docking connector and ensuring the signal, the cable connector assembly is proved with a locking device for latching with the docking connector. U.S. Pat. No. 5,971,790 issued to Rohde, discloses a conventional cable connector assembly provided with a locking device. The locking device disclosed in the Rohde comprises a pair of locking arms disposed at opposite sides of the cable connector assembly. Each arm is provided with a forwardly extending locking portion for latching with corresponding portion of the docking connector and a backwardly extending button exposed outside of a cover provided on the cable connector assembly. Pressing and driving inwardly the buttons of the locking device, the locking portion will deflect outwardly to engage or disengage with the docking connector.

However, there is any hidden trouble in the cable connector assembly without the function of plug and play. For example, the cable connector assembly is able to be pull out of the notebook computer being in use after pressing inwardly the buttons of the locking device, this accident may result in the notebook computer halt and even information processing on the notebook lost.

A cable connector assembly is desired to overcome the disadvantages of the prior art.

SUMMARY OF THE INVENTION

An object of the present invention to provide a cable connector assembly with an anti-disengagement for preventing an untimely disengagement of the cable connector assembly from a complementary connector.

To achieve the above object, An electrical connector includes an insulative housing, a plurality of terminals retained in the housing, a locking device for locking with a complementary connector and an anti-disengagement device having a holding status and a releasing status and being reverseable between the two status. Only when the anti-disengagement is in the releasing status, the locking device be able to engage with or disengage from the complement connector.

Other objects, advantages and novel features of the present invention will be drawn from the following detailed description of the preferred embodiments of the present invention with the attached drawings, in which:

DETAILED DESCRIPTION OF THE INVENTION

Reference will now be in detail to the preferred embodiments of the present invention.

Figure 1:
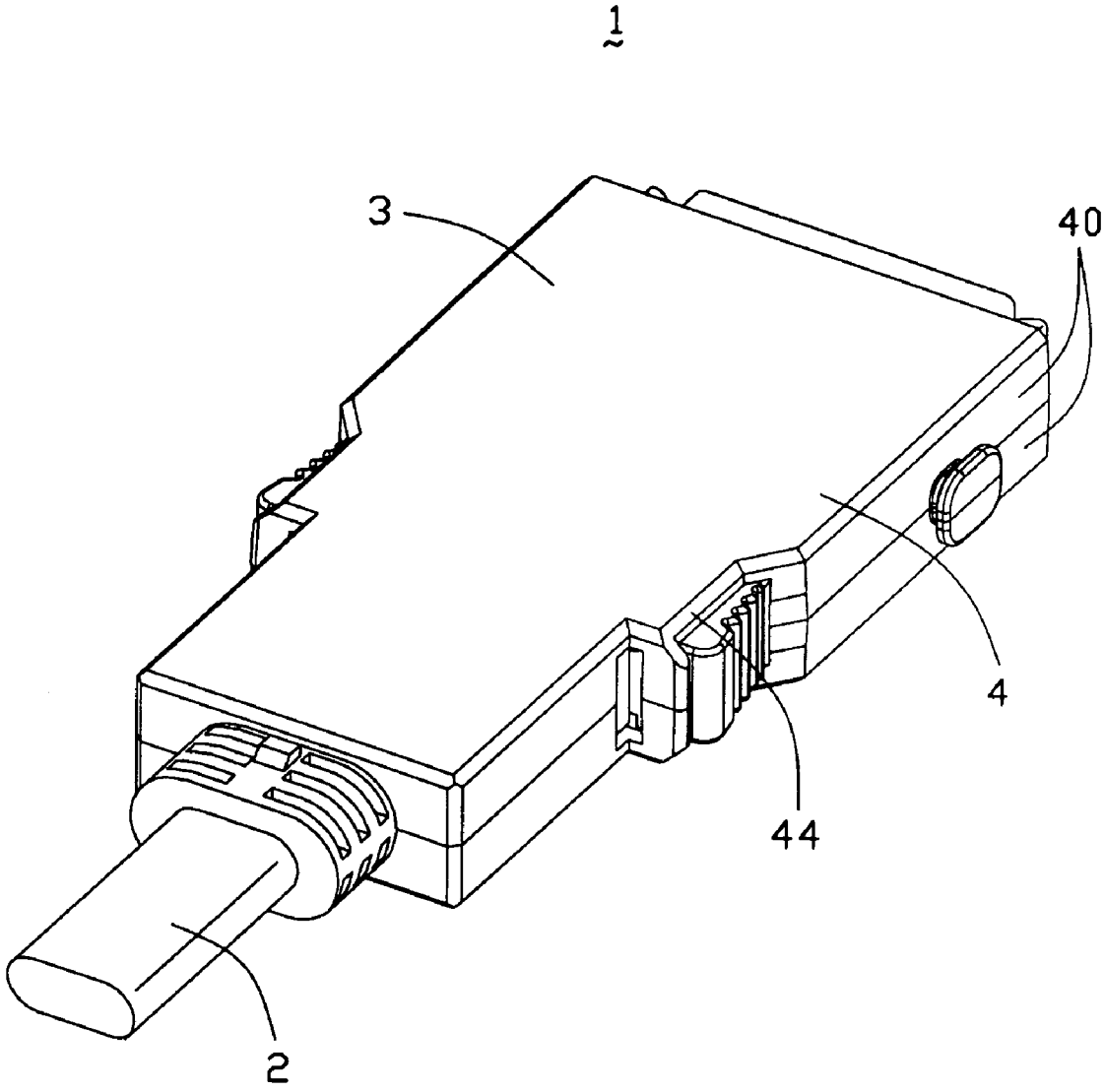
FIG. 1 is an assembled perspective view of a cable connector assembly in accordance with the present invention.

Referring to FIG. 1, an cable connector assembly 1 in accordance with a preferred embodiment of the present invention includes a cable end connector 3 adapted for connecting with a docking connector (not shown) which is provided on a notebook and a cable 2 provided with one end for connecting with the cable end connector 3 and the other end for connecting with periphery equipments, such as a printer or a scanner.

Figure 2:
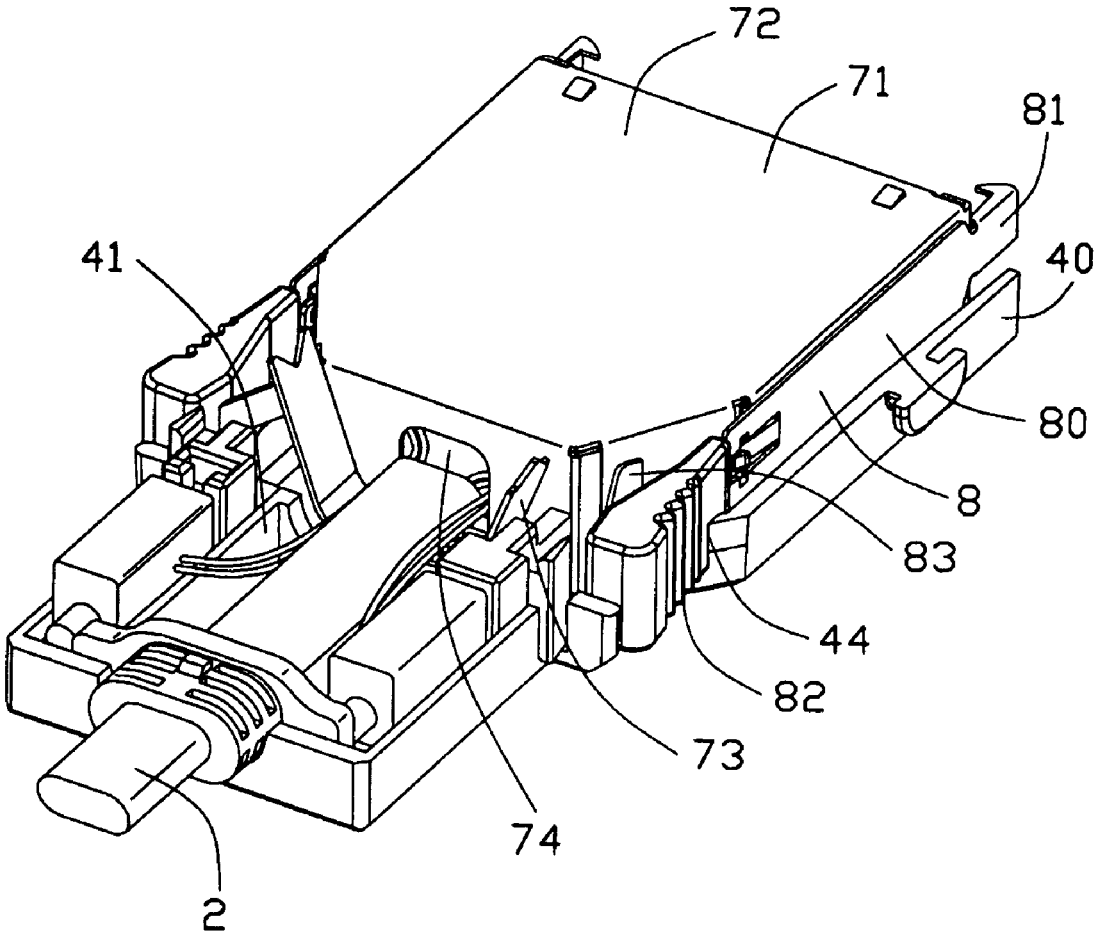
FIG. 2 is an assembled perspective view of the cable connector assembly of FIG. 1 with an insulative cover-half disassembled.
Figure 3:
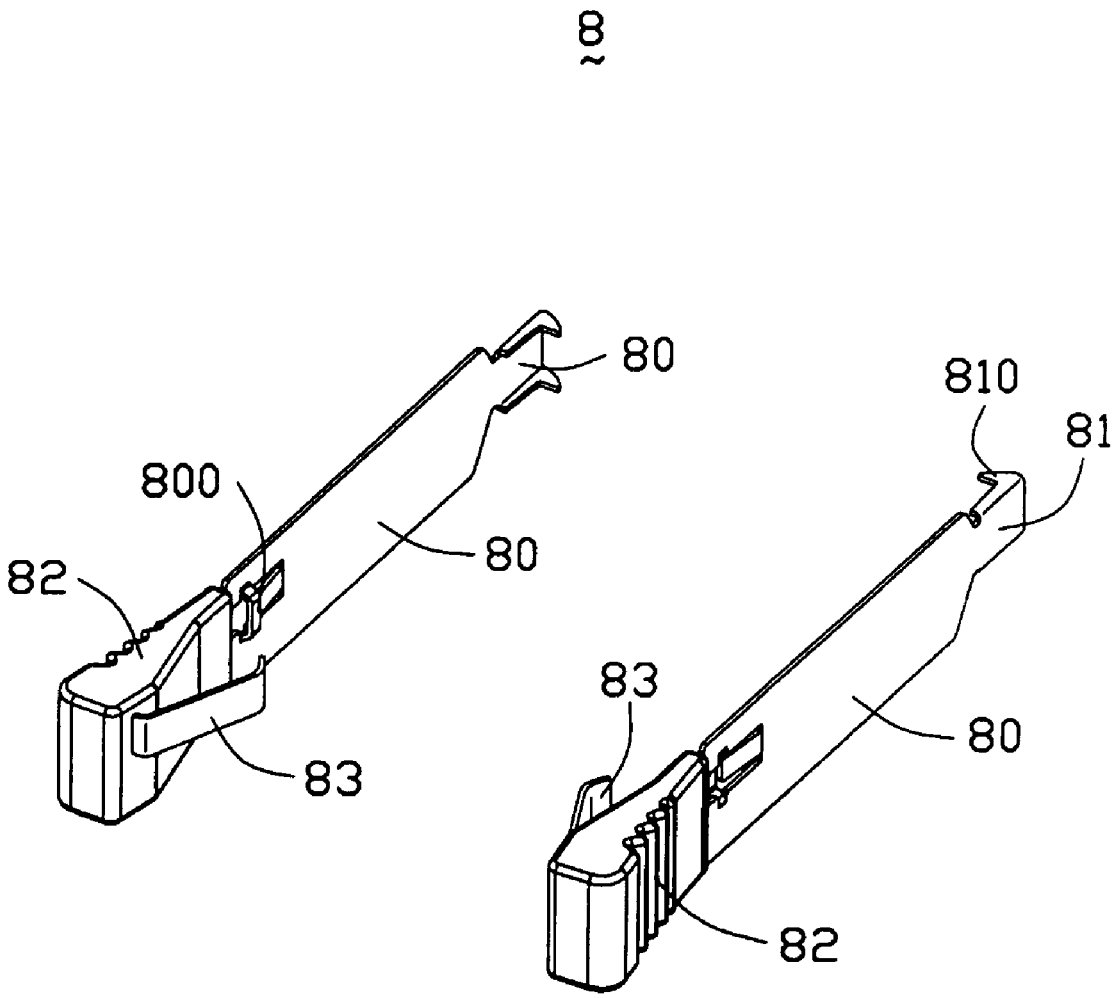
FIG. 3 is an perspective view of a locking device of the cable connector assembly shown in FIG. 2.
Figure 4:
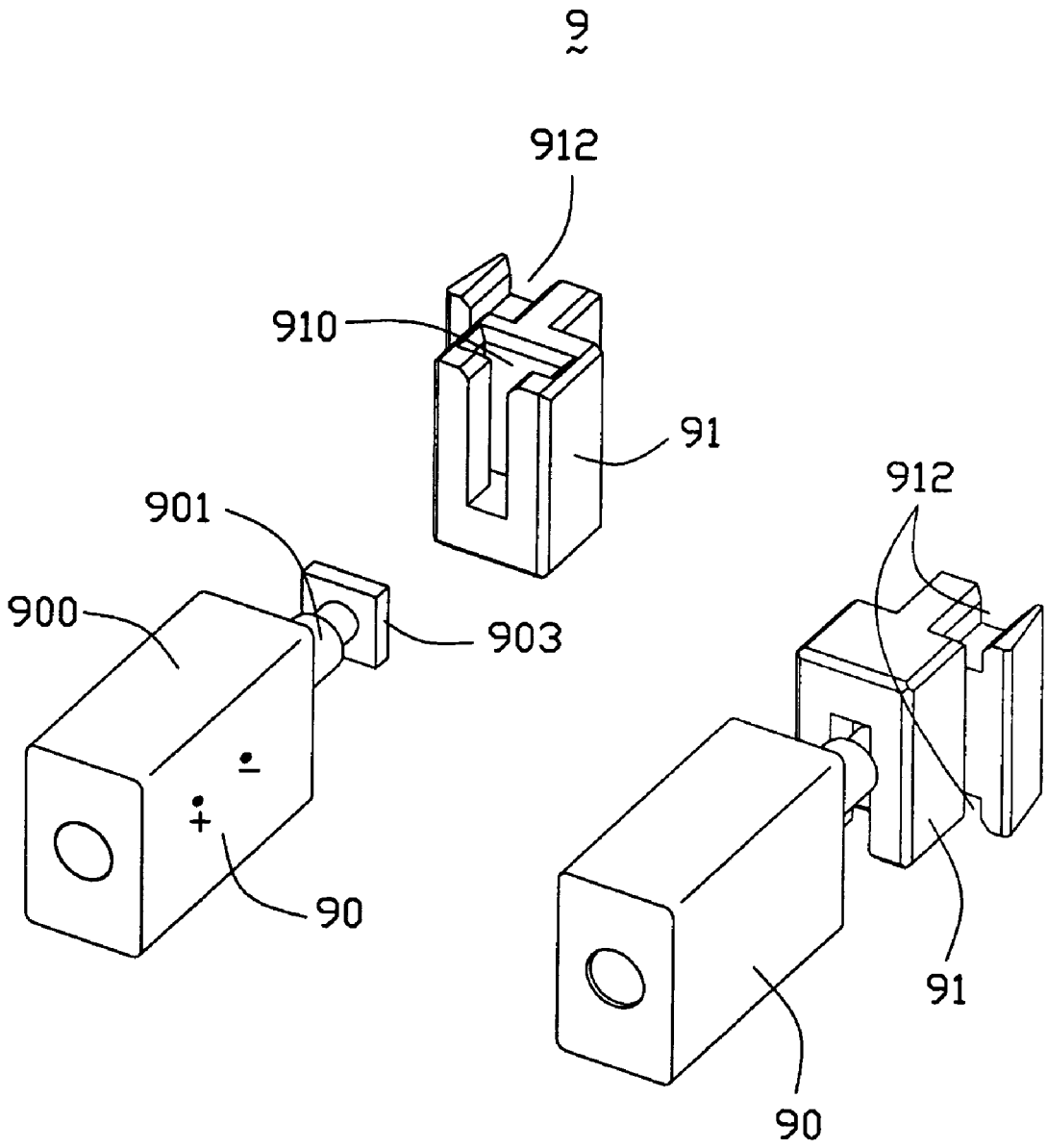
FIG. 4 is a perspective view of an electromagnetic anti-disengagement device of the cable connector assembly.

Referring to FIG. 1 in conjunction with FIG. 2, the cable end connector 3 is provided with an insulative cover 40 consisting of a pair of substantially symmetric cover-halves 40. After the cover-halves 40 engage with each other to form the whole insulative cover 4, chambers defined in inner faces of the cover-halves will confine together to form a receiving cavity 41. The insulative cover 40 is provided with a pair of openings 42, 43 respectively on front and rear ends thereof communicating with the receiving cavity 41.

Figure 5:
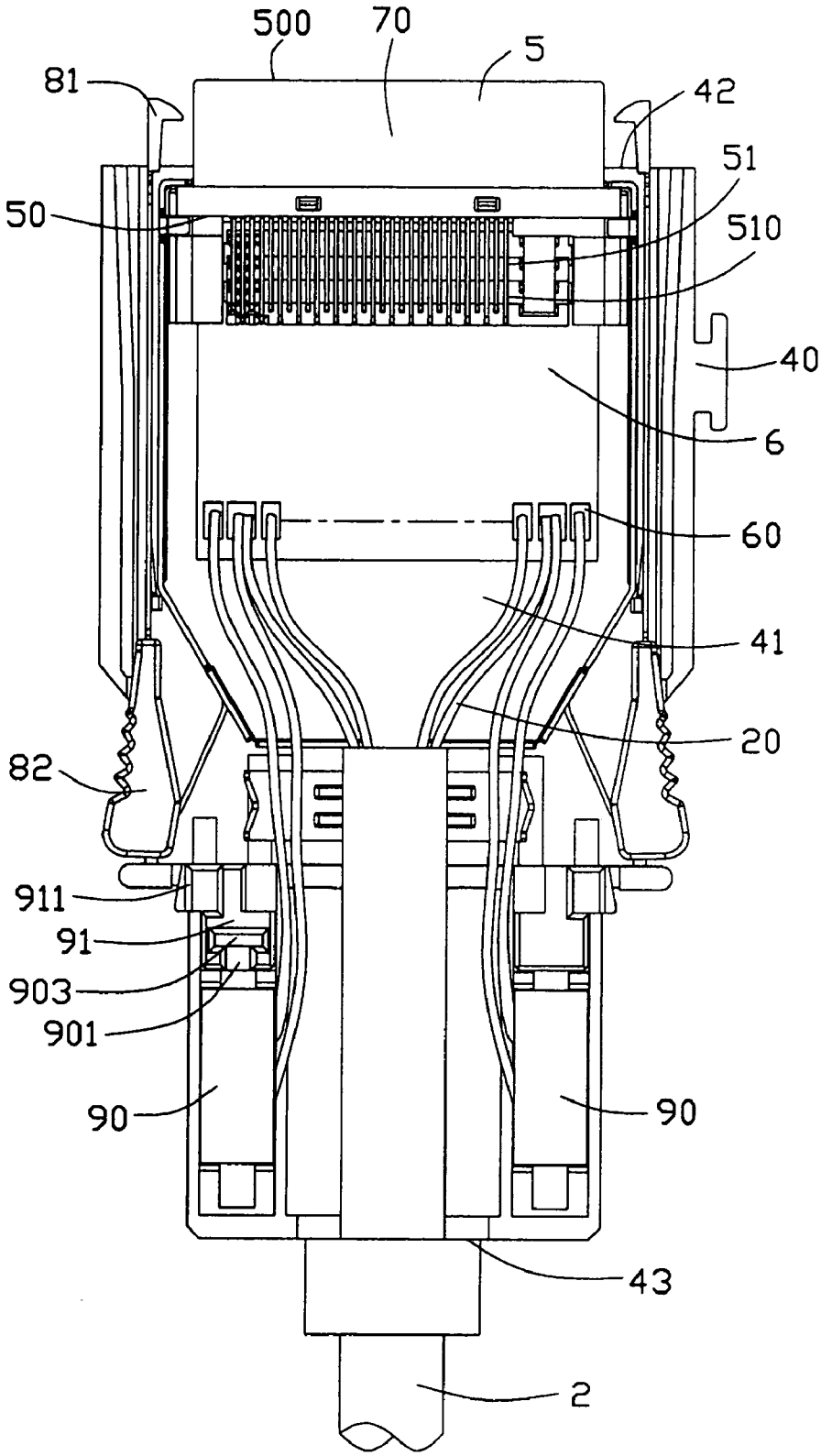
FIGS. 5–6 are a top elevational view of the cable connector assembly provided with the electromagnetic anti-disengagement device with the insulative cover-half and a metallic disassembled, showing an operating principle of the electromagnetic anti-disengagement device.

Referring to FIG. 2 in conjunction with FIG. 5, the cable end connector 3 comprises a terminal module 5 which comprises an insulative housing 50 and a plurality of terminals 51 retained in the insulative housing 50, and a printed circuit board (PCB) 6 receiving in the receiving cavity 4. A rear end of the insulative housing 50 is retained in the receiving cavity defined by the insulative cover 4. A front end of the insulative housing 50 passes through the opening 42 to serve as a mating port 500. Each terminal 51 has a contacting portion (not shown) extending forwardly into the mating port 500 for electrically connecting with the docking connector and a tail portion 510 extending backwardly out of the housing for electrically soldering on a front end of the PCB 6. The cable 2 comprises a plurality of wires 20 electrically soldering on a rear end of the PCB 6 with one end thereof passing through the opening 43 of the insulative cover 4, thereby the terminal module 5 is electrically connecting with the cable 2 by the PCB.

In order to ensure the reliable signal transmission in the cable connector assembly 3, the cable end connector 3 is provided with a shielding system for avoiding electronic magnetic interference (EMI). The shielding system includes a first shielding frame 70 enclosing the insulative housing 50 and a second shielding frame 71 enclosing a rear end of the terminal module 5 and the whole PCB 6. A rear end of the first shielding frame 70 is overlapped with a front end of the second shielding frame 71. The first and the second shielding frames 71 are formed and stamped from metallic material. The second shielding frame 71 consists of a pair of cover-halves and is provided with an opening 74 through which the cable 2 passes.

In order to ensure the engagement between the cable connector assembly 1 and the docking connector, the cable connector assembly 1 is provided with a pair of locking arms 8 serving as a locking device, referring to FIG. 5. The locking arms 8 are disposed at opposite side of the insulative cover 4. Each locking arm 8 has a main portion 80 disposed in a corresponding slit between the second shielding frame 71 and the insulative cover 4, a locking portion 81 extending forwardly from the main body 80 beyond the insulative cover 4 for latching with corresponding portion of the docking connector, and a button 82 extending backwardly out of the insulative cover 4 from the main body 80. A resilient finger 83 extends inwardly and forwardly from the button 82 to abut against the second shielding frame 71. The main body 80 is formed with a projection 800 abutting against the second shielding frame 71. The operation of the locking device 8 is described as follow.

Referring to FIG. 2, firstly pressing inwardly the button 82 and driving the button 82 to deflect inwardly around the projection 800, whereby the locking portion 81 deflects outwardly for latching with corresponding portion of the docking connector and the resilient portion 83 is deformed. Secondly releasing the button 82, the locking portion 81 return to original position to latch with corresponding portion of the docking connector due to the resilience of the resilient portion 83, whereby the cable connector assembly 1 is engaged with the docking connector. Apparently, the cable connector assembly 1 is disengaged from the docking connector according to similar operation.

Referring to FIG. 2, the cable end connector 3 is further provided with an anti-disengagement device 9 for preventing an untimely disengagement of the cable connector assembly 1 from the docking connector. The anti-disengagement device 9 has two embodiments, one of which is an electromagnetic type, referring to FIGS. 4–7, and the other of which is an electromotor type, referring to FIGS. 8–11.

The electromagnetic anti-disengagement device 9 is disposed in the receiving cavity 41 and located at back of the locking arm 8. The electromagnetic anti-disengagement device 9 comprises an electromagnetic component 90 and a holding component 91. The electromagnetic component 90 has a main body 900 being immobile relative to the insulative cover 4 and a moveable portion 901 moveable relative to the main body. The moveable portion 901 connects with the holding component 91 with a distal head 903 thereof retained in a T-shaped cutout 910 of the holding component 91, whereby the holding component 91 is able to move along with the moveable portion 901. The holding component 91 defines a guiding channel 912 for guiding purpose when moving. When the power for the electromagnetic component 90 turns on, the moveable portion 901 moves forwardly and pushes the holding portion 91 to a holding position, referring to FIG. 6. At this time, the holding portion 91 abut against an inner face of the button 82 so that the button 82 is not able to deflect inwardly after being pressed, whereby the locking portion 82 can't unlock from the docking connector in this status. In this status, turning off the power for the electromagnetic component 90, the moveable portion 901 will return and pull the holding portion 91 to a releasing position, referring to FIG. 5. At this time, the holding portion 91 make a room for an inward deflection of the button 82, whereby the locking portion 82 can normally unlock from the docking connector in this status.

Figure 7:
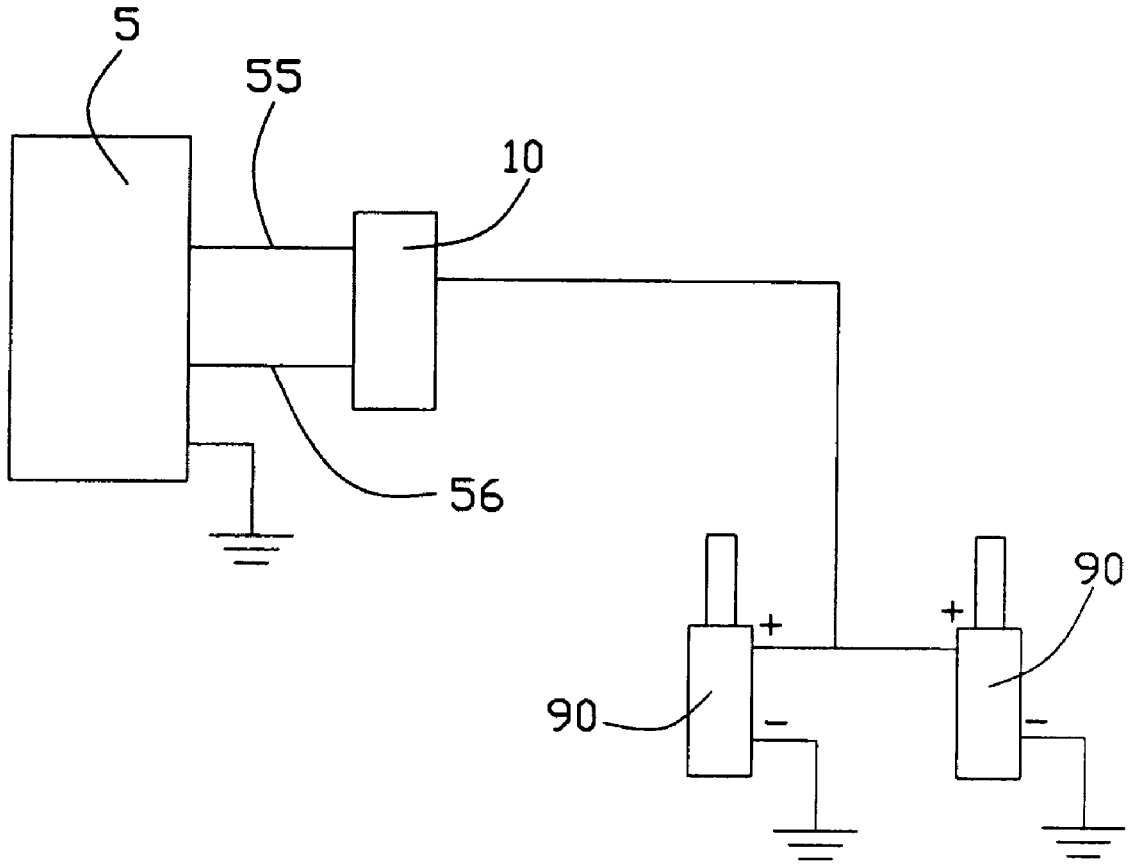
FIG. 7 is a schematic circuit diagram of the operating principle of the electromagnetic anti-disengagement device.
Figure 8:
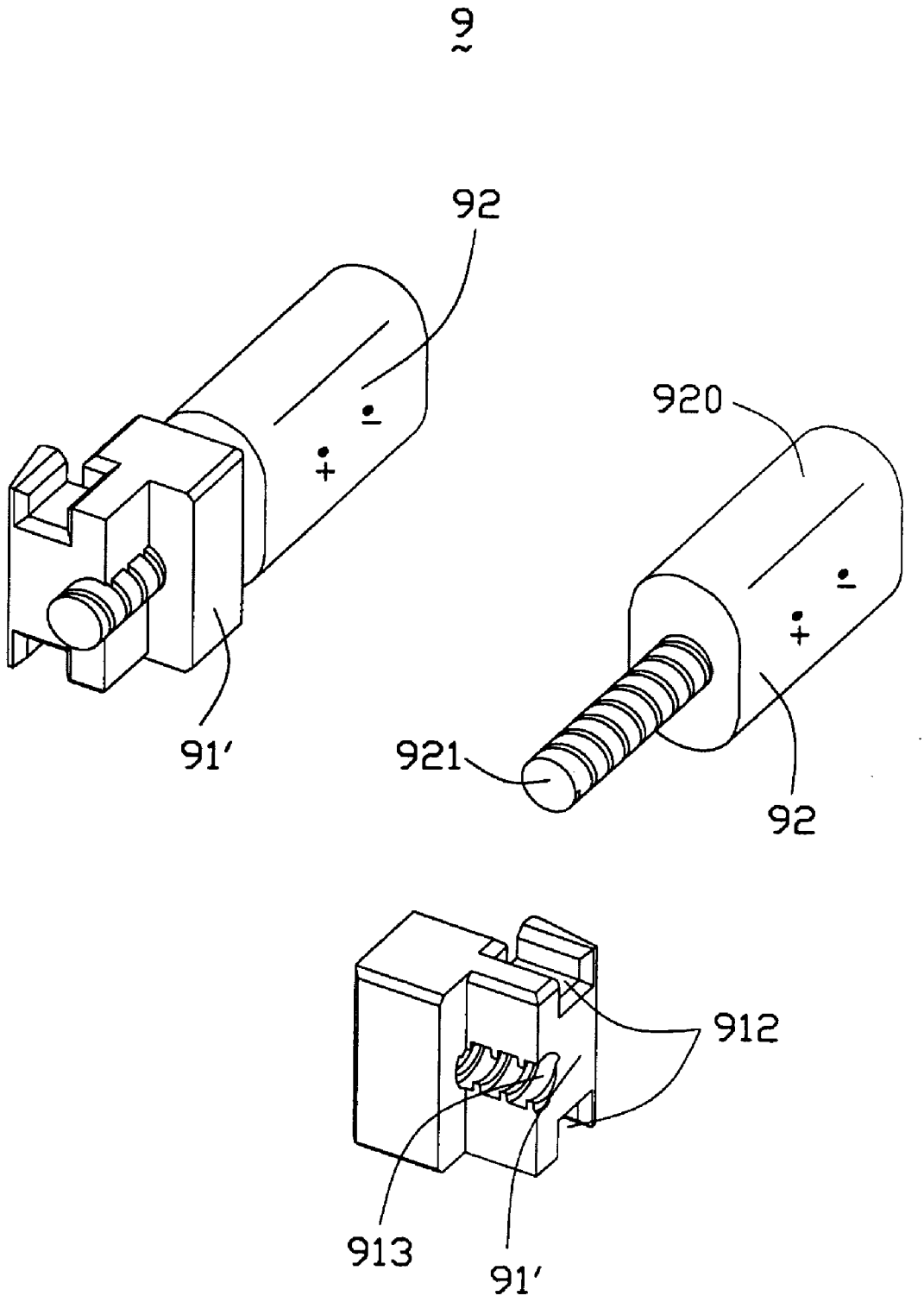
FIG. 8 is a perspective view of an electromotor anti-disengagement device of the cable connector assembly.

Referring to FIG. 7, the terminals 51 comprises a controlling signal terminal 55, a power terminal 56 for supplying power for the electromagnetic component 90. The cable end connector 3 is provided with a controlling element 10 disposed on the PCB 6. The controlling signal terminal 55 and the power terminal 56 electrically connects corresponding inputs of the controlling element 10. An output of the controlling element 10 electrically connects with a power input of the electromagnetic component 90 for power supply.

Figure 6:
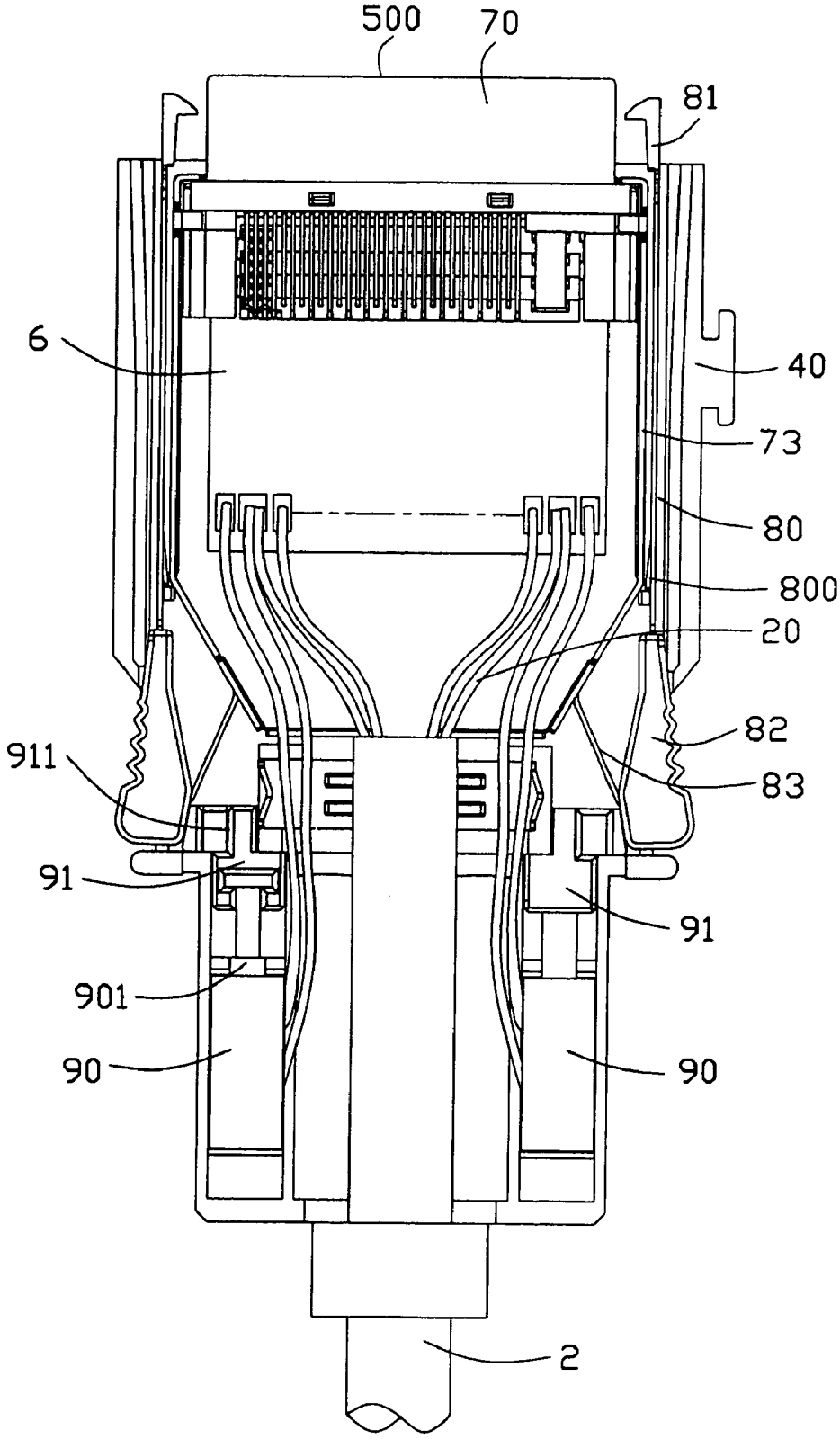

In conjunction with FIGS. 5–6, plugging the cable connector assembly 1 in the notebook computer which is already in use or turning on the notebook computer after the cable connector assembly is plug in, a locking signal from the notebook computer will be transmit into the controlling element 10 by the controlling signal terminal 55, then the controlling element 10 switch on and the power in the power terminal 56 is supplied for the electromagnetic component 90 by the controlling element 10. At this time, the holding portion 91 is pushed to the locking position shown as FIG. 6, whereby the cable connector assembly can't disengaged from the notebook computer because the button 82 is held in it position. In this status, turning off the notebook computer or carrying out a program in the notebook computer, an unlocking signal from the notebook computer will be transmit into the controlling element 10 by the controlling signal terminal 55, then the controlling element 10 switch off and the power in the power terminal 56 for the electromagnetic component 90 turns off. At this time, the holding portion 91 return the releasing position shown as FIG. 5, whereby the cable connector assembly can normally disengaged from the notebook computer because the button 82 is released.

Referring to FIGS. 8–11, the electromotor anti-disengagement device 9 comprises an electromotor 92 and a holding component 91'. The electromotor 92 has a stator 920 being immobile relative to the insulative cover 4 and a rotor 921. The rotor 921 connects with the holding component 91' with a screw distal end thereof retained in a screw hole 913, whereby the holding component 91 is able to move along a front-to-back direction when the rotor 921 rotates. The holding component 91' also defines a guiding channel 912 for guiding purpose when moving. When the power is positively supplied for the electromotor 92, the rotor 921 positive and pushes the holding portion 91 to a holding position, referring to FIG. 10. At this time, the holding portion 91' abut against an inner face of the button 82 so that the button 82 is not able to deflect inwardly after being pressed, whereby the locking portion 82 can't unlock from the docking connector in this status. In this status, negatively supplying power for the electromotor 92, The rotor 901 reverses and pull the holding portion 91 to a releasing position, referring to FIG. 9. At this time, the holding portion 91 make a room for an inward deflection of the button 82, whereby the locking portion 82 can normally unlock from the docking connector in this status.

Figure 11:
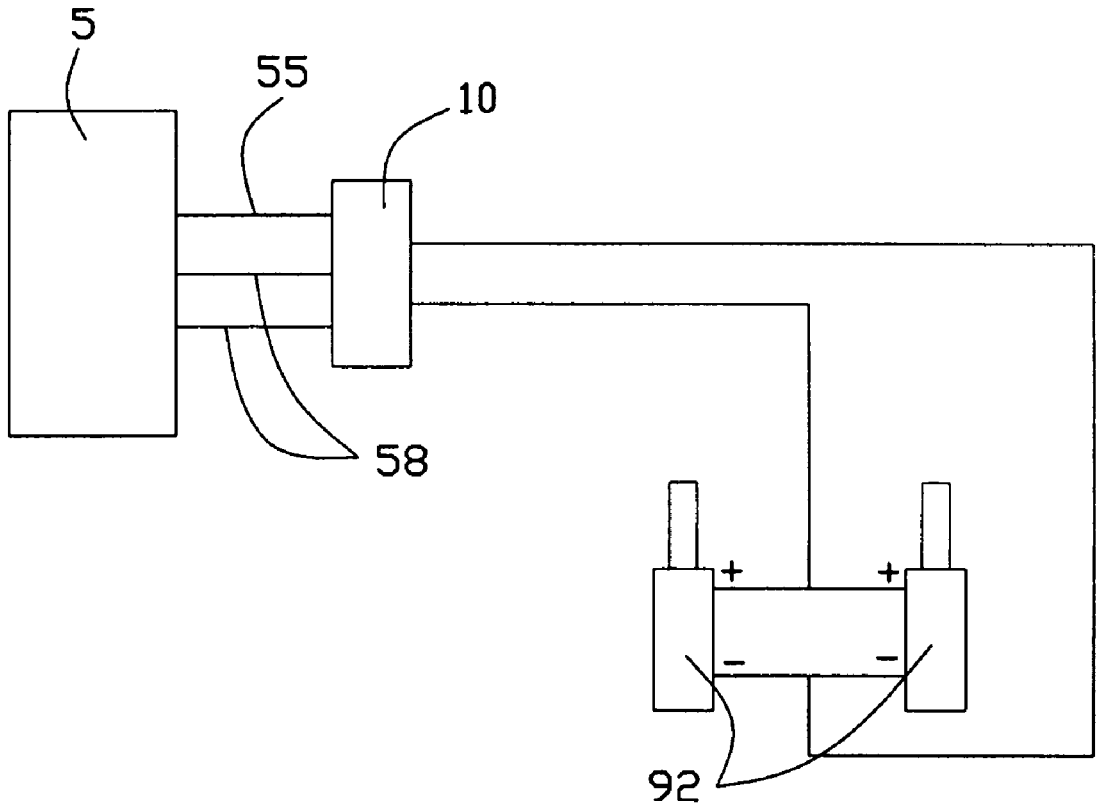
FIG. 11 is a schematic circuit diagram of the operating principle of the electromotor anti-disengagement device.

Referring to FIG. 11, the terminals 51 comprises a pair of power terminals 58 for supplying power for the electromotor 92. The controlling signal terminal 55 and the power terminals 58 electrically connects corresponding inputs of the controlling element 10. Outputs of the controlling element 10 electrically connect with power inputs of the electromotor 92 for power supply.

Figure 9:
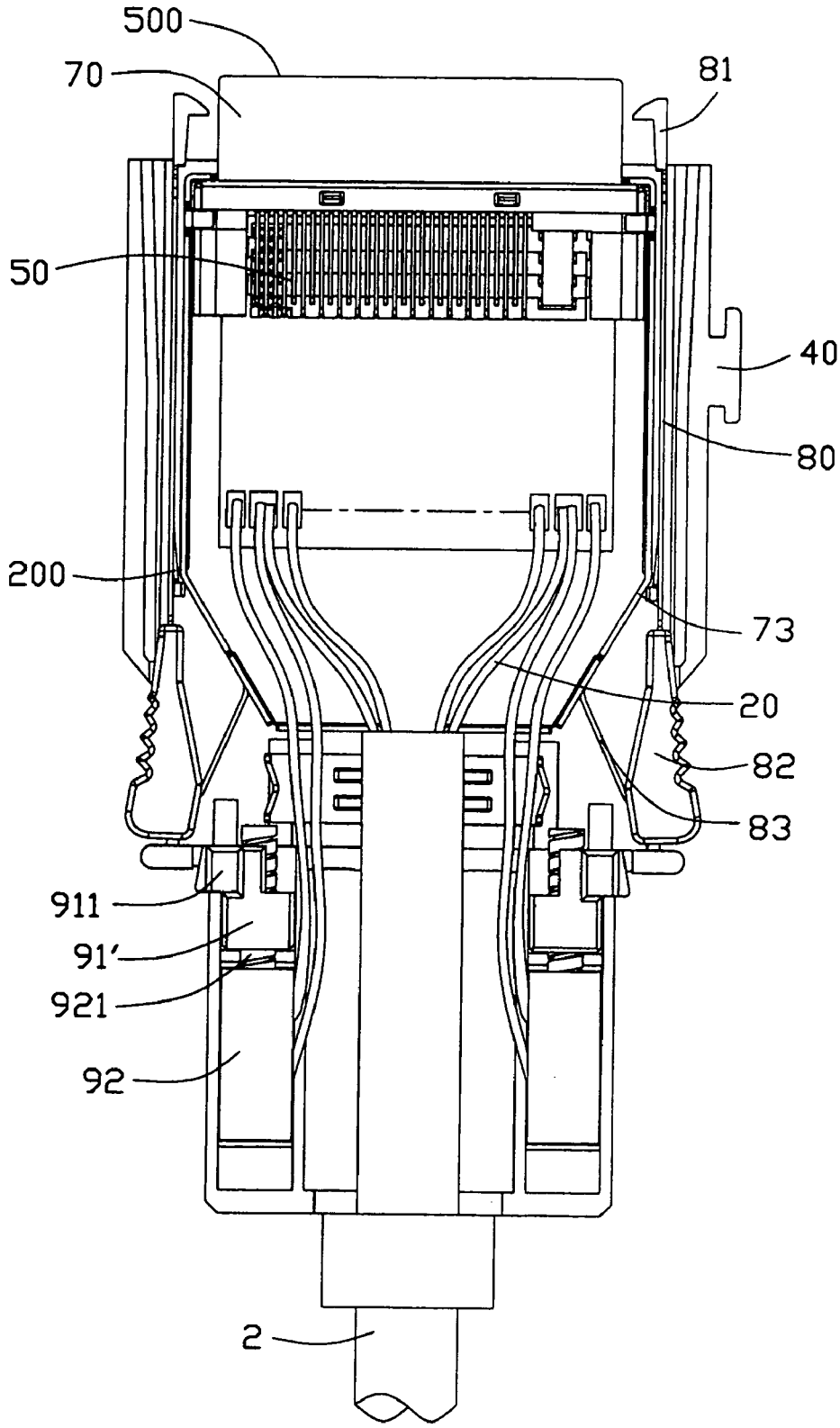
FIGS. 9–10 are a top elevational view of the cable connector assembly provided with the electromotor anti-disengagement device with the insulative and the metallic cover-halves disassembled, showing an operating principle of the electromotor anti-disengagement device.
Figure 10:
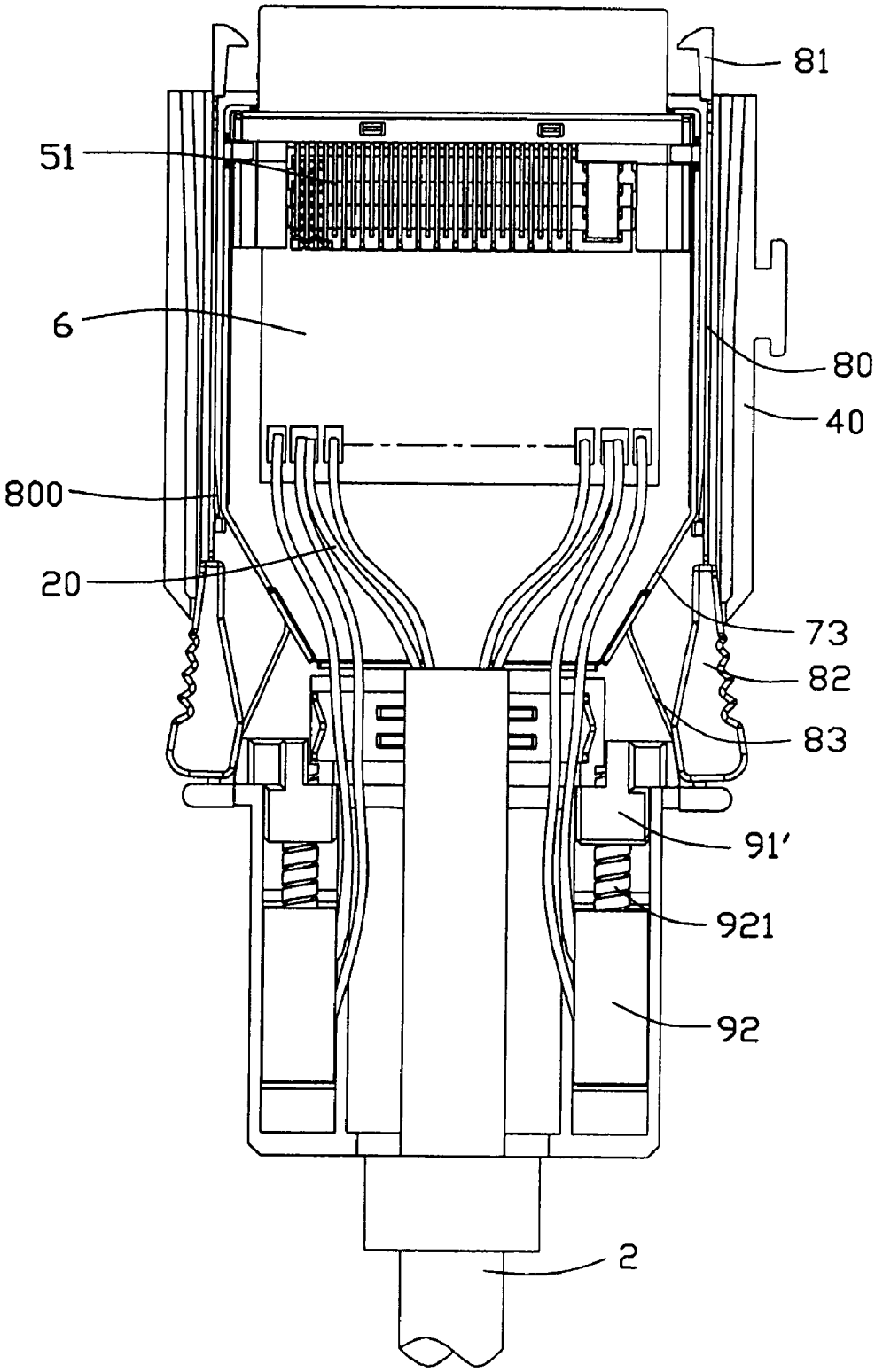

In conjunction with FIGS. 9–10, plugging the cable connector assembly 1 in the notebook computer which is already in use or turning on the notebook computer after the cable connector assembly 1 is plug in, a locking signal from the notebook computer will be transmit into the controlling element 10 by the controlling signal terminal 55, then the controlling element 10 switch on and the power in the power terminal 58 is positively supplied for the electromotor 92 by the controlling element 10. At this time, the holding portion 91' is pushed to the locking position shown as FIG. 10, whereby the cable connector assembly can't disengaged from the notebook computer because the button 82 is held in it position. In this status, carrying out a program in the notebook computer, an unlocking signal from the notebook computer will be transmit into the controlling element 10 by the controlling signal terminal 55, then the controlling element 10 reverse and the power in the power terminal 58 is negatively supplied for the electromotor 92. At this time, the holding portion 91' return the releasing position shown as FIG. 9, whereby the cable connector assembly 1 can normally disengaged from the notebook computer because the button 82 is released.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

What is claimed is:

1. An electrical connector comprising:

an insulative housing;

a plurality of terminals retained in the housing and comprising, a controlling signal terminal for transmitting locking/unlocking signals and power terminal for supplying power;

a moveable locking device for locking with a complementary connector;

an electromagnetic anti-disengagement device comprising a holding component defining a holding position and a releasing position and actuated by the power provided by the power terminal to be reversible between the two positions; wherein when the power is provided on the electromagnetic anti-disengagement device, the holding component is pushed into the holding position so as to prevent the locking device moving to lock or unlock the complementary connector; when the power turns off, the holding component automatically returns back into the releasing position, the locking device can be moved to lock or unlock the complementary connector;

further comprising a printed circuit board having a controlling element for electrically connecting the terminals with the electromagnetic device; wherein the controlling signal controls the power of the power terminal turning on or off by transmitting locking/unlocking signals into the controlling element; wherein said anti-disengagement device includes an electromagnetic component used for controlling the holding component moveable nearby the locking device to block/unblock movement of the said locking device; wherein the electromagnetic component has a main body being immobile relative to the housing and a moveable portion having a distal end retained in the holding component.

2. The connector as claimed in claim 1, wherein the connector is a cable connector equipped with said locking device.

3. The connector as claimed in claim 1, wherein said locking device is moved in a lateral direction rather than a front-to-back direction.

4. The connector as claimed in claim 3, wherein said anti-disengagement device includes a holding component moveable nearby the locking device along the front-to-back direction for blocking/unblocking movement of said locking device.

5. A method of making electrical connection, comprising steps of:

providing an electrical connector, for mating with a complementary connector, with an insulative housing and a plurality terminals therein;

providing the connector with a moveable locking device for locking/unlocking the complementary connector; and providing the connector with an electrically actuated anti-disengagement device which defines holding and releasing statuses;

providing a printed circuit board (PCB) electrically connecting the terminals with the anti-disengagement device; wherein when the anti-disengagement device is in the holding status, the locking device can not lock or unlock the complementary connector; wherein the anti-disengagement is in the releasing status, the locking device can lock or unlock the complementary connector; wherein once the connector is coupled to the complementary connector, the anti-disengagement device is automatically switched to the holding status; wherein the terminals comprises a controlling signal terminal for transmitting locking or unlocking signals to the PCB and a power terminal for providing power to the anti-disengagement device to actuate the anti-disengagement device moving between the holding position and the releasing position; wherein said locking device is moved in lateral direction rather than a front-to-back direction; wherein said anti-disengagement device includes a holding component moveable around the locking device along the front-to-back direction for blocking/unblocking movement of said locking device.

6. An electrical connector comprising:

an insulative housing;

a plurality of terminals retained in the housing;

a moveable locking device for locking with a complementary connector;

an electrically actuated anti-disengagement device defining a holding position and a releasing position and being reversible between the two positions and comprising a holding component at one end thereof; wherein when the anti-disengagement device is in the holding position, the holding component abuts against the locking device so that the locking device can not be moved to lock or unlock the complementary connector; when the anti-disengagement is in the releasing position, the holding component spaced a distance from the locking device so that the locking device can be moved to lock or unlock the complementary connector; wherein the anti-disengagement device comprises an electromotor component has a main body being immobile relative to the insulative housing and a rotor for keeping the holding component moving in a front-to-back direction by rotary movement; wherein the rotor is provided with a screw distal end retained in the holding component; wherein some of terminals provide power for the anti-disengagement device to make the rotor in rotary movement, further comprising a printed circuit board (PCB) electrically connecting the terminals with the anti-disengagement device, further comprising a shielding system encasing the insulative housing, the terminals and the PCB therein; wherein the locking device consists of a pair of locking arms located at lateral sides of the shielding system.

* * * * *